United States Patent [19]

Riexinger et al.

[11] Patent Number: 4,470,444

[45] Date of Patent: Sep. 11, 1984

[54] SHUTTER LINK FOR A MULTI-LINK OVERHEAD SHUTTER OF ROLLER BLIND

[75] Inventors: Gustav Riexinger, Brackenheinm-Hausen; Rudolf Nagel, Schöneich, both of Fed. Rep. of Germany

[73] Assignee: Tuerenwerke Riexinger GmbH & Co. KG, Brackenheim-Hausen, Fed. Rep. of Germany

[21] Appl. No.: 308,551

[22] PCT Filed: Jul. 30, 1980

[86] PCT No.: PCT/EP80/00068

§ 371 Date: Oct. 2, 1981

§ 102(e) Date: Oct. 2, 1981

[30] Foreign Application Priority Data

Feb. 18, 1980 [DE] Fed. Rep. of Germany ..... 3006056

[51] Int. Cl.[3] ..... F06B 3/12

[52] U.S. Cl. ..... 160/235; 160/232

[58] Field of Search ..... 160/232, 235

[56] References Cited

U.S. PATENT DOCUMENTS

| | | | |
|---|---|---|---|
| 546,858 | 9/1895 | Kinnear | 160/232 |
| 880,701 | 3/1908 | Vance | 160/235 |
| 1,352,656 | 9/1920 | Cahill | 160/232 |
| 3,004,324 | 10/1961 | Macomber | 29/460 X |
| 3,511,301 | 5/1970 | Graham et al. | 160/232 UX |
| 3,547,603 | 12/1970 | Bragman | 29/418 |
| 3,967,671 | 7/1976 | Stanley et al. | 160/232 |
| 3,968,561 | 7/1976 | Oakes et al. | 29/460 |
| 4,162,571 | 7/1979 | Horvay | 29/460 |

*Primary Examiner*—Peter M. Caun

*Attorney, Agent, or Firm*—Fitzpatrick, Cella, Harper & Scinto

[57] ABSTRACT

For the purpose of manufacturing a shutter link for an overhead shutter or a multi-link roller blind, two metallic sheet-metal shells are made which are provided at their ends with hinge elements of claw-like shape. In order to avoid undesirable deformation during the operation of joining the metallic sheet-metal shells together, such deformation being particularly apt to occur in the vicinity of the narrow sides, it is intended to provide the two shells with longitudinally extending beads adjacent to the two hinge elements.

4 Claims, 5 Drawing Figures

SHUTTER LINK FOR A MULTI-LINK OVERHEAD SHUTTER OF ROLLER BLIND

CROSS REFERENCE TO RELATED APPLICATIONS

This application contains subject matter related to subject matter in International Application No. PCT/EP80/00066 filed in the United States Designated Office on Oct. 2, 1981 and accorded U.S. Ser. No. 308,552 (U.S. Pat. No. 4,416,047, issued Nov. 22, 1983).

The invention relates to a shutter link for a multi-link overhead shutter or roller blind of the kind having external and internal shells enclosing a cavity and having their longitudinal edge portions bent in mutual engagement to provide claw-shaped sections forming hinge elements.

DESCRIPTION OF THE PRIOR ART

Such a link has, for example, been disclosed in the earlier German Patent Application No. P 29 26 144.7-25 (corresponds to U.S. Pat. No. 4,416,047, issued Nov. 22, 1983). An individual link comprises, for example, a metallic hollow section including an outer shell member and an inner shell member, such two shell members being formed by two profiled strips of metal. Along their longitudinal edges said metallic strips are bent in such a manner as to form portions of claw-like cross section, said portions being in mutual engagement so as to form hinge elements. Said hinge elements are of rotationally symmetrical shape, the result being that also the cross-sectional shape of the leaf is rotationally symmetrical. During manufacture of such a link, said metallic strips are first profiled in such a manner that, after having been joined together, they enclose a hollow space, and the longitudinal edge portions of the metallic strips are bent simultaneously so as to be given a claw-like cross-sectional shape and to engage said longitudinal edge portions with one another. During this bending operation, the presence of differing radii of curvature of the bent portions and a possible displacement of the narrow sides of the hollow space accompanying this operation may cause said narrow sides of the hollow space to be indented towards said space. This is particularly undesirable if the upwardly facing small side of the hollow space is indented in such a manner that it is possible, under unfavorable conditions, that water collects in such indentations.

Therefore, it is the object of the invention to provide a shutter link of the kind mentioned above in which the occurrence of such indentations in the walls of the hollow space is avoided.

SUMMARY OF THE INVENTION

This object is attained by the provision of a shutter link as described above, said shutter link being constructed, according to the invention, by providing the inner and/or outer shell with a longitudinally extending bead disposed in the area between a hinge element and the adjacent narrow side of the cavity formed between the shells. Advantageous embodiments of the invention and a preferred method of manufacturing them are indicated in the sub-claims.

The invention provides for the inner and/or outer shell to be provided with a longitudinally extending bead disposed between a hinge element and the adjacent narrow side of the hollow space or cavity. This bead compensates for the differences in length which, during bending of the two shells in mutual engagement, are caused by the differing radii of curvature. In order to compensate for this difference in length it is sufficient to provide a bead in that shell which has the smaller radius of curvature in the corresponding hinge element. This bead prevents the adjacent narrow side of the cavity from being bent inwardly.

In a preferred modification of the invention, a bead is provided at the corresponding locations in both the outer shell and the inner shell, these beads being in mutual engagement. This measure permits the attainment of an additional fixation of the outer shell in relation to the inner shell, the result being that the shells cannot be displaced in relation to one another as the upper and under sides are engaged by a bending operation for the purpose of forming hinge elements.

For manufacturing the shutter link of the invention it is contemplated to assemble the shutter link by joining two profiled metallic strips, such metallic strips being profiled and provided with beads by means of a roller forming machine. In connection with this operation, the beads may be formed by means of additional rolls; however, it is also possible to give the forming rolls serving to profile the metallic strips a shape corresponding to the beads to be formed. In both cases, the beads are formed before the strips are joined and before the hinge elements are formed.

BRIEF DESCRIPTION OF THE DRAWINGS

The invention will be described and explained hereinafter with reference to embodiments shown in the figures.

There is shown in

DETAILED DESCRIPTION OF THE PREFERRED EMBODIMENTS

Figure 1:
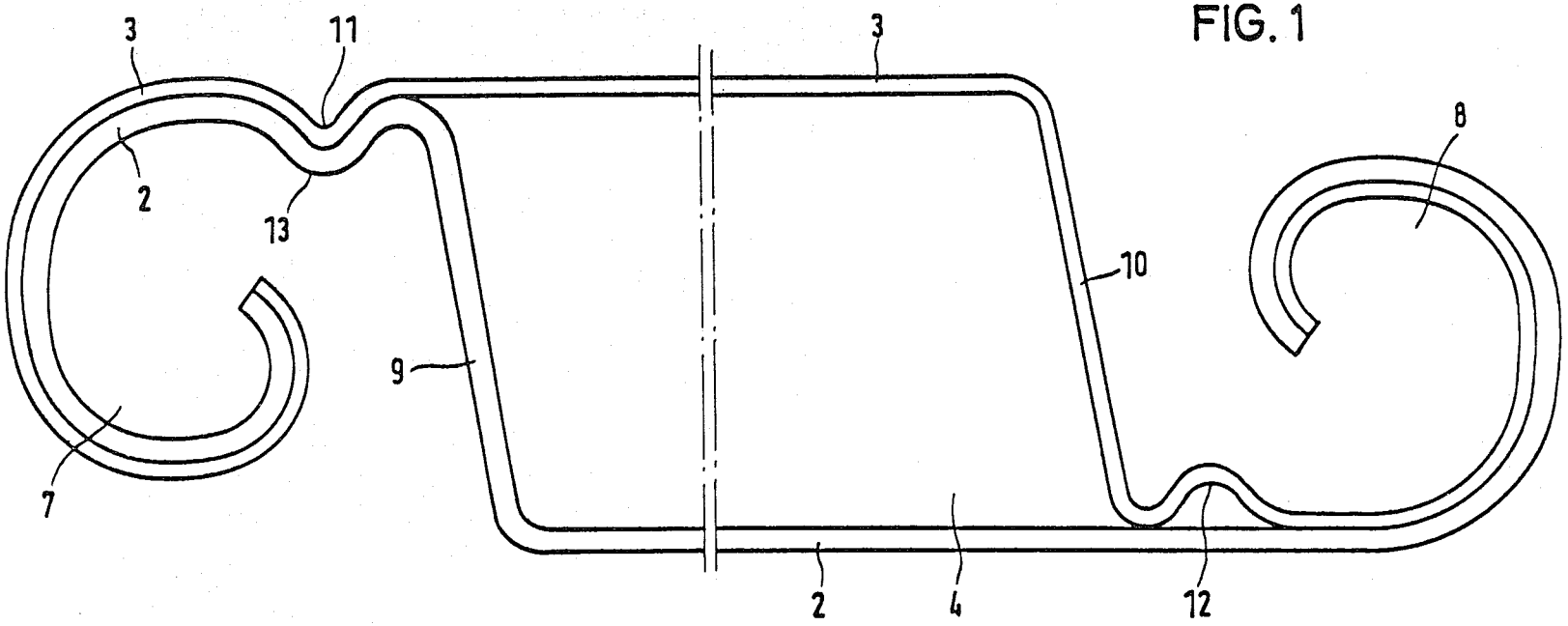
FIG. 1 is a cross-section of a shutter link according to one embodiment of the invention.

FIG. 1 shows a cross-section of a shutter link according to the invention. The shutter link is composed of an external shell 2 and an inner shell 3 having a smaller wall thickness than the outer shell. The outer shell and the inner shell are profiled in such a manner that they define a cavity 4. In addition, the longitudinal edge portions of the shells are bent in mutual engagement to form hinge elements 7 and 8. As shown in the right-hand part of FIG. 1, a bead 12 is provided in the wall of the inner shell between the hinge element 8 and the narrow side 10 of the cavity. This bead 12 compensates for the difference in length which results while the end portions of the shells are turned inwardly in mutual engagement to form the hinge element 8.

In the left-hand part of FIG. 1 it is shown that, between the hinge element 7 and the narrow side 9 of the cavity, the inner shell 3 is provided with a bead 11 and that also the outer shell 2 is provided with a corresponding bead 13. These beads are formed in such a way that they are in mutual engagement and that they prevent the inner shell and the outer shell from being displaced in relation to one another.

Figure 2:
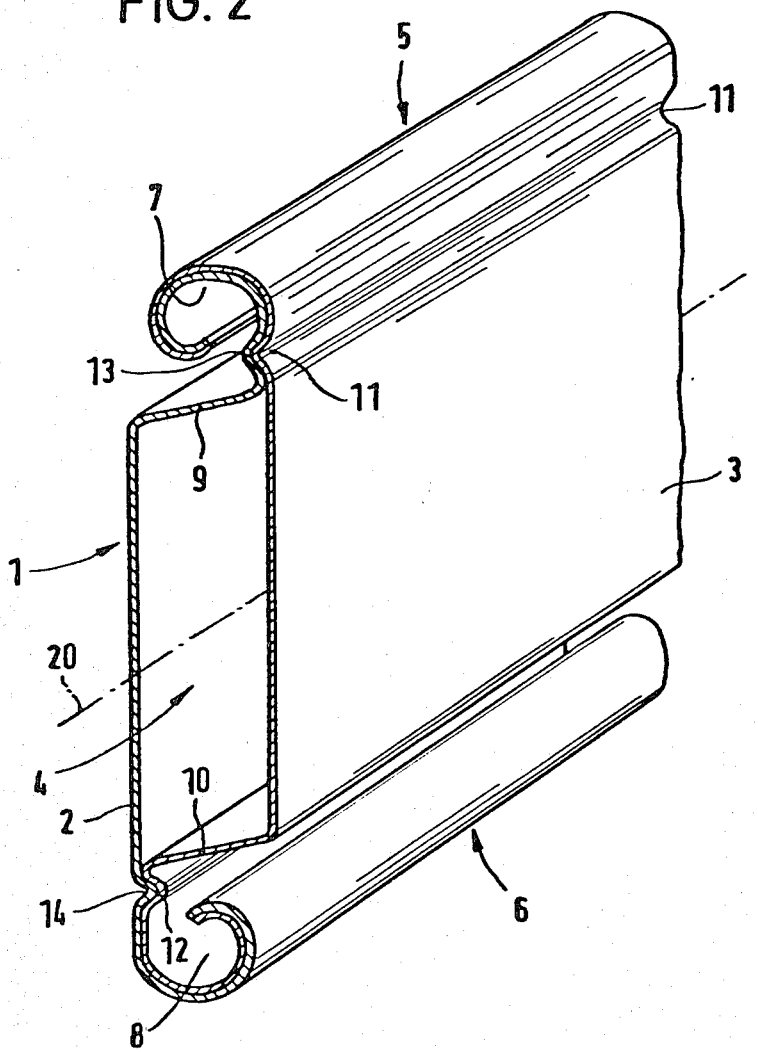
FIG. 2 is a perspective of a shutter link according to a second embodiment of the invention.

FIG. 2 is a perspective representation of a shutter link according to the invention which is provided with beads in both the upper hinge element 7 and the lower hinge element 8. Said beads are provided in both the inner shell 3 and the outer shell 2. The beads 11 and 13 and the beads 12 and 14, respectively, are in mutual engagement. The beads extend parallel to the longitudinal edges 5 and 6 of the shutter link. The cross-sectional shape of the shutter link is rotationally symmetrical to the axis 20.

Figure 3:
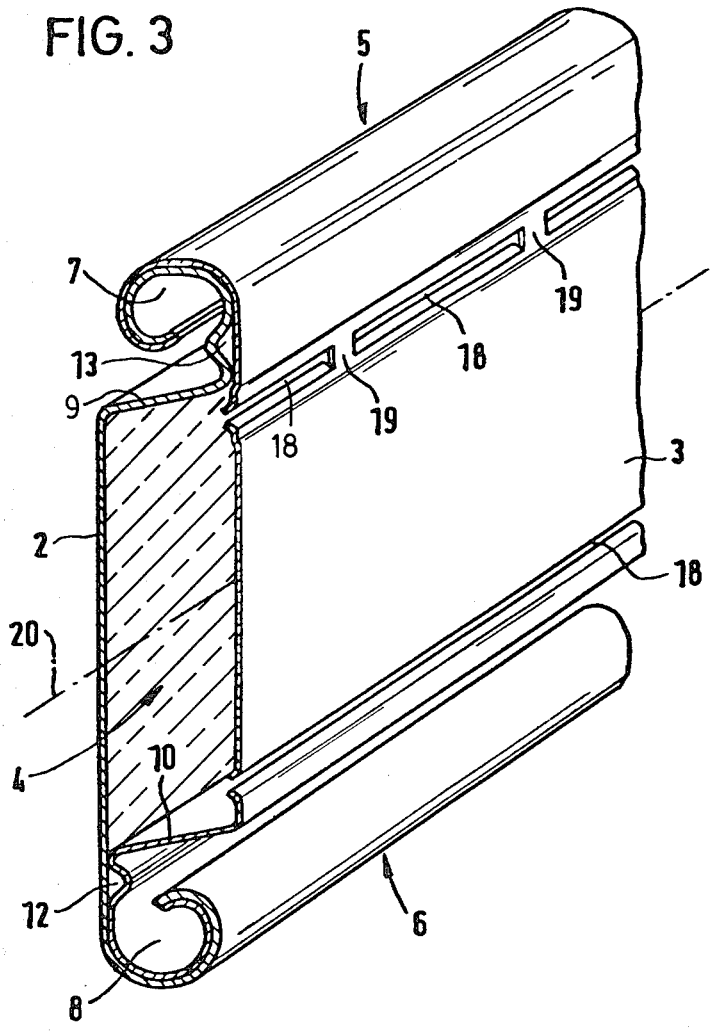
FIG. 3 is a perspective of a shutter link according to a third embodiment of the invention.

FIG. 3 shows another embodiment of the shutter link according to the invention. In this embodiment, a bead is only provided in that shell which forms the inside portion of the adjacent hinge element 7 and 8, respectively. Thus, in the upper hinge element 7, only the outer shell 2 is provided with a bead 13 with the inner shell 3 extending rectilinearly; conversely, only the inner shell 3 is provided with a bead 12 in the vicinity of the lower hinge element 8 with the outer shell 2 extending rectilinearly. It is further shown in FIG. 3 that the inner shell 3 may be provided with slots 18. These slots 18 also extend parallel to the longitudinal edges 5 and 6 of the shutter link. These slots 18 are provided for the purposes of reducing the transfer of heat from the inner shell 3 disposed on the inner side of the shutter and the outer shell 2 so as to improve the heat insulation provided by the shutter. Such a slot 18 may be bridged by individual webs 19 in order to maintain the tensile strength of the shutter link. These webs 19 are only shown in the upper part of FIG. 3.

In order further to improve heat insulation, it is also possible to fill the cavity 4 of the shutter link with a foam material as shown in FIG. 3.

Figure 4:
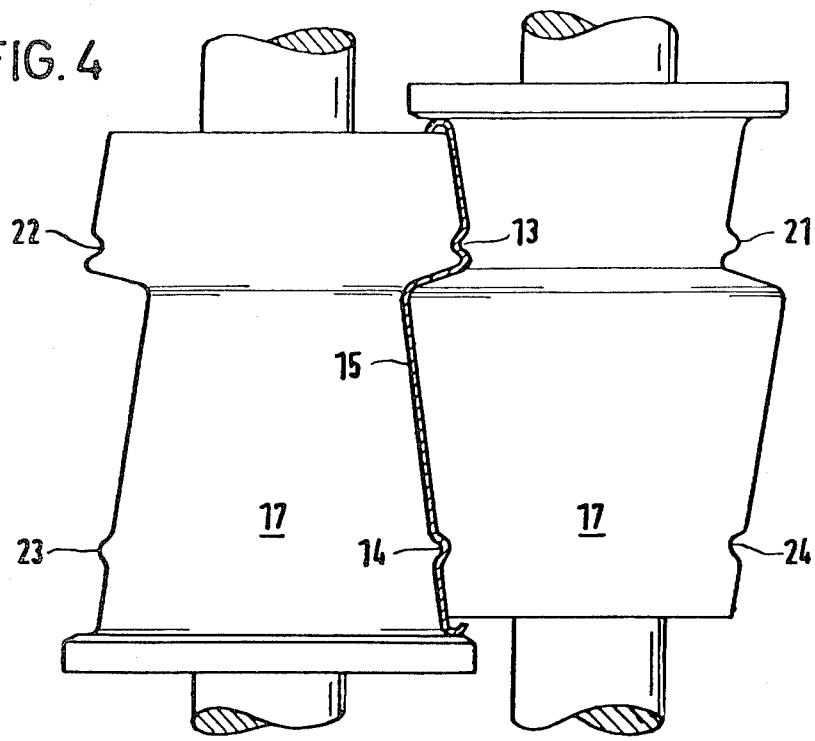
FIGS. 4 and 5 are forming rolls for manufacturing a shutter link composed of metallic strips.
Figure 5:
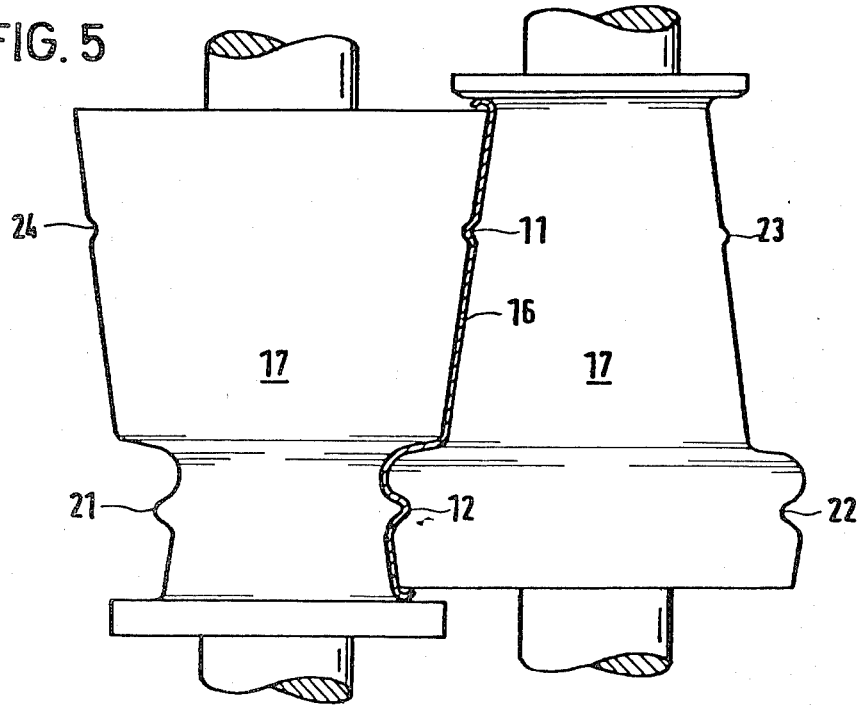

FIGS. 4 and 5 show forming rolls 17 by means of which metallic strips 15 and 16 are profiled. The forming rolls are provided with mutually associated projections 21, 23 and grooves 22, 24 which are in mutual engagement during rotation of the rolls so as to provide the metallic strips 15 and 16 with beads 11, 12, 13 and 14. As may also be seen in the representation of FIGS. 4 and 5, these beads 11 to 14 are formed before the metallic strips 15 and 16 are joined to form a hollow section. As a matter of principle, however, it would also be possible first to employ the forming rolls to give the strips an angular shape, then to join the strips to form a hollow section, thereafter to form the beads by subjecting the assembled hollow section to a pressing action and finally to form the hinge elements.

We claim:

1. A shutter link for a multi-link overhead shutter or roller blind comprising an inner shell and an outer shell, said shells being contiguous to each other along opposite edge regions and being bent around together in said edge regions to form first and second claw-shaped hinge elements, the bends forming the hinge elements being in mutually opposite directions at the opposite edge regions so that the inner shell forms the inside of the first hinge element and the outer shell forms the inside of the second hinge element, the portions of said shell between said contiguous opposite edge regions being parallel to each other and spaced apart to form a central hollow space, the inner shell being formed with a first bead in its contiguous edge region between said hollow space and said first hinge element, said first bead extending parallel to said first hinge element, and the outer shell being formed with a second bead in its contiguous edge region between said hollow space and said second hinge element, said second bead extending parallel to said second hinge element.

2. A shutter link according to claim 1, wherein said inner shell is formed with a further bead in its contiguous edge region between said hollow space and said second hinge element, said further bead being in mutual engagement with said second bead.

3. A shutter link as claimed in claim 1, characterized in that the outer shell and the inner shell are made of metal.

4. A shutter link as claimed in claim 1, characterized in that the hollow space is filled with a foam material.

* * * * *